US005635034A

United States Patent [19]

Viitanen et al.

[11] Patent Number: 5,635,034

[45] Date of Patent: Jun. 3, 1997

[54] SUCTION ROLL OR CYLINDER AND METHOD FOR REMOVING AIR FROM A SUCTION ROLL OR CYLINDER

[75] Inventors: Olavi Viitanen, Jyväskylä; Raimo Virta, Turku, both of Finland

[73] Assignee: Valmet Corporation, Helsinki, Finland

[21] Appl. No.: 637,554

[22] Filed: Apr. 25, 1996

[30] Foreign Application Priority Data

Mar. 7, 1996 [FI] Finland ..... 961055

[51] Int. Cl.[6] ..... D21F 3/10

[52] U.S. Cl. ..... 162/368; 162/363; 162/367; 162/369; 162/370; 492/20; 492/55

[58] Field of Search ..... 162/363, 367, 162/368, 369, 370, 371, 372, 217; 34/116, 117, 120, 128; 492/20, 55

[56] References Cited

U.S. PATENT DOCUMENTS 5,022,163 6/1991 Ilvespaa et al. ..... 34/23
5,024,729 6/1991 Kuhasalo et al. ..... 162/372

*Primary Examiner*—Donald E. Czaja
*Assistant Examiner*—Steven B. Leavitt
*Attorney, Agent, or Firm*—Steinberg, Raskin & Davidson, P.C.

[57] ABSTRACT

A method for removing air from a suction roll/suction cylinder and a suction roll/suction cylinder including a roll mantle, end flanges connected to the roll mantle and axle journals for revolvingly supported the roll mantle. The mantle has numerous perforations, holes or equivalent openings passing therethrough. The suction roll/suction cylinder is connected to a suction duct that passes onto the interior of the roll/cylinder and transfers a vacuum force therein. Air is drawn or sucked through the perforations into the interior of the roll mantle so as to press a paper web toward an outer face of the roll mantle. The suction roll/suction cylinder has a system of suction pipes connected with the suction duct and including at least one suction pipe into which air is guided and/or sucked from the vicinity of the inner face of the roll mantle of the roll/cylinder.

20 Claims, 3 Drawing Sheets

SUCTION ROLL OR CYLINDER AND METHOD FOR REMOVING AIR FROM A SUCTION ROLL OR CYLINDER

FIELD OF THE INVENTION

The present invention relates in general to a suction member and more particularly to a suction roll or suction cylinder which comprises a roll mantle, end flanges connected to ends of the mantle and roll axle journals connected to the end flanges and on whose support the suction roll/suction cylinder revolves. The roll mantle comprises numerous perforations, holes or equivalent openings passing therethrough. The suction roll/suction cylinder is connected to a suction duct that passes into the interior of the roll mantle and transfers a vacuum force or negative pressure into the roll mantle. Air is thus drawn or sucked through the perforations into the interior of the roll mantle to press the paper web toward the outer face of the roll mantle and from the interior of the roll mantle through the suction duct.

The present invention also relates to a method for removing air from a roll or cylinder such as suction roll or suction cylinder.

BACKGROUND OF THE INVENTION

In the following description, in order to simplify the description, the designation "suction roll" will be used instead of suction member. This does not, however, restrict the invention in any way whatsoever, but rather the term suction roll refers to various suction rolls, suction cylinders, and equivalent suction members.

With respect to the prior art, reference is first made to the current assignee's Finnish Patent No. 83,680 (corresponding to U.S. Pat. No. 5,022,163, which is incorporated by reference herein), which describes a suction roll for supporting the paper web which does not comprise a suction box in the interior of the roll. Rather, the suction roll is constructed such that it comprises perforations in the roll mantle and, at the ends of the perforations, a separate recess, preferably a groove, through which the vacuum is distributed over a wider area on the roll face so as to produce a suitable suction force across the paper web. In this manner, with a favorable dimensioning of the perforations, an adequate holding force to hold the web is obtained without the need to place a suction box or an equivalent arrangement in the interior of the suction roll mantle.

When air is removed out of a revolving roll whose mantle is perforated and whose interior is empty, through a hollow centrally-located shaft or suction pipe in the shaft, in the suction pipe in the shaft a vortex is formed, which produces a high flow resistance and, thus, makes the removal of air from the roll mantle interior more difficult. With respect to the prior art related to this concept, reference is also made to the current assignee's Finnish Pat. No. 82,849 (corresponding to U.S. Pat. No. 5,024,729, which is incorporated by reference herein), which describes an embodiment related to the problems described above. In the suction roll in accordance with FI Pat. No. 82,849, it is considered a novelty that the suction roll comprises at least a vortex prevention equipment placed at the vicinity of the suction pipe of the suction roll. This vortex prevention equipment comprises at least one plate part which has a face substantially parallel to the radius of the roll, i.e., transverse to the axial direction of the roll, and which vortex prevention equipment is arranged in such a way in relation to the end of the suction pipe that, in an operative suction situation, increasing vortex formation in the sucked air is prevented and, thus, the vacuum level/negative pressure force is kept at a desired, substantially invariable value on the inside face of the roll mantle across the entire width of the roll. Also, the flow rate of suction air through the perforations in the roll mantle is kept at a desired, substantially invariable value. However, in this prior art construction, problems have still been caused by the pressure loss produced by the centrifugal force arising from the speed of rotation.

OBJECTS AND SUMMARY OF THE INVENTION

Accordingly, it is an object of the present invention to suggest a novel solution for the problem described above which arises from the fact that, during its rotation, the suction roll produces a resistance against the air to be sucked, which air resistance increases when the speed of rotation increases and thus makes removal of air out of the roll more difficult. Also, in this case, the centrally-arranged suction force must also overcome the resistance arising from rotation. When the suction takes place from the hole in the shaft of the roll, the negative pressure dependent on the speed of rotation of the roll center, i.e., the difference in pressure arising from the centrifugal force, is about 300 Pa to about 500 Pa even if the suction effect has not yet been switched on. Thus, an object of the present invention is also to overcome this negative pressure and, at the same time, to provide a solution thereto in which the dynamic pressure produced by the rotation of the roll (about 200 Pa to about 300 Pa) in the air is utilized.

It is another object of the present invention to provide a new and improved suction apparatus in which the same suction air flow is produced in the air duct with a clearly lower vacuum, compared with the prior art suction apparatus.

It is a further object of the present invention to provide a suction member such as a suction roll in which a vacuum source is not connected with the suction duct at all.

It is yet another object of the present invention to provide a new and improved suction apparatus such as a suction roll by whose means it is effectively possible to remove a large quantity of air through perforations in the suction roll without a pressure loss arising from centrifugal force.

It is another object of the present invention to provide a new and improved method for removing air from an interior of a roll or cylinder such as a suction roll or suction cylinder.

In view of achieving the objects stated above, those that will come out later and others, the suction member in accordance with the invention, which may be a suction roll or suction cylinder, comprises a system of suction pipes connected with a centrally arranged suction duct, i.e., a suction duct extending through or defined within one or both of the axle journals of the roll. The system of suction pipes includes at least one suction pipe arranged in the interior of the roll to which air is guided and/or sucked from the vicinity of an inner face of the roll mantle of the roll/cylinder.

In a suction roll in accordance with the present invention, the lowering of the vacuum level in the duct is achieved so that a stationary system of suction pipes has been installed in the interior of the roll through the suction opening of the suction roll, and the suction openings in the system of suction pipes are directed against the rotational movement of the roll and are placed in the vicinity of, i.e., proximate to, the outer circumference of the roll near the inner face of the roll mantle. The air to be sucked is thus drawn or taken from the outer circumference of the layer of air revolving inside the roll from the lowest vacuum and, at the same time, the dynamic motive energy of the revolving air is also utilized. In this manner, a lower vacuum is achieved in the system of suction ducts with the same quantity of air, compared with a prior art suction roll in whose interior there is no system of suction pipes. In this way, economies are obtained in the consumption of energy.

In the arrangement in accordance with the invention, when the speed of rotation of the roll increases, the requirement of vacuum in the suction duct of the suction roll also becomes lower, which also reduces the consumption of energy of the apparatus used for the generation of vacuum, such as, for example, blowers. In the arrangement of the present invention, the flow of suction air in the suction duct can also be produced completely without a source of vacuum by utilizing the centrifugal air flows.

The invention is particularly well suitable for use in suction rolls in which there is no inside suction box, such as, for example, the current assignee's suction rolls of the "VAC ROLL"™ type, whose construction is described in detail, e.g., in the current assignee's Finnish Pat. No. 83,680 mentioned above.

In its most general embodiment, the suction member in accordance with the invention includes a roll mantle defining an interior, end flanges arranged at ends of the roll mantle and axle journals connected to the end flanges for rotatingly supporting the roll mantle. At least one of the axle journals defines a suction duct in flow communication with an interior of the roll. The roll mantle has an outer face, an inner face and plurality of apertures extending from the outer face to the inner face. Suction means are provided for drawing air into the interior of the roll through the apertures and from the interior of the roll through the suction duct. The suction means comprise a suction pipe system arranged in flow communication with the suction duct and which includes at least one suction pipe extending within the interior of the roll to a location proximate the inner face of the roll mantle such that air is guided and/or sucked from the location proximate the inner face of the roll mantle through the suction pipe system into the suction duct. The suction pipe(s) can extend from a centrally arranged flange part in a radial direction toward the inner face of the roll mantle. Also, if more than one suction pipe is provided, the suction pipes are preferably placed substantially in a common plane in a direction transverse to an axial direction of the suction member and extend from the flange part in opposite directions in relation to one another. The suction pipe(s) can also be elongate and have a first end connected to the flange part and a second end opposed to the first end opening at the location proximate to the inner face of the roll mantle, the pipe(s being sealed between the first and second ends.

The method in accordance with invention for removing air from an interior of a suction roll is applicable for a suction roll including a roll mantle, end flanges arranged at ends of the roll mantle and axle journals connected to the end flanges for rotatingly supporting the roll mantle, and whereby at least one of the axle journals defines a suction duct and the roll mantle has an inner face. The method comprises the steps of directing air from a location proximate the inner face of the roll mantle into and through at least one suction pipe extending within the interior of the roll to the location proximate the inner face of the roll mantle, fluidly coupling the suction pipe(s) to the suction duct, and applying negative pressure through the suction duct.

In other embodiments of the method, there are a pair of elongate suction pipes, each of which has an end having a suction opening adjacent to the inner face of the roll mantle. The suction openings of the suction pipes are oriented in a direction substantially perpendicular to a direction of air flow rotating in the interior of the roll during rotation of the roll. The suction pipe(s) may be mounted in a stationary position during operative rotation of the roll. Also, the roll can be rotated at a first speed, and the suction pipe(s) rotated at a second speed substantially slower than the first speed of rotation of the roll. The roll may also be rotated in a first direction of rotation whereby the suction pipe(s) is/are rotated in a second direction of rotation opposite to the first direction of rotation of the roll.

In the following, the invention will be described in more detail with reference to the figures in the accompanying drawing. However, the invention is not in any way strictly confined to the details of the illustrated embodiments alone.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1B:
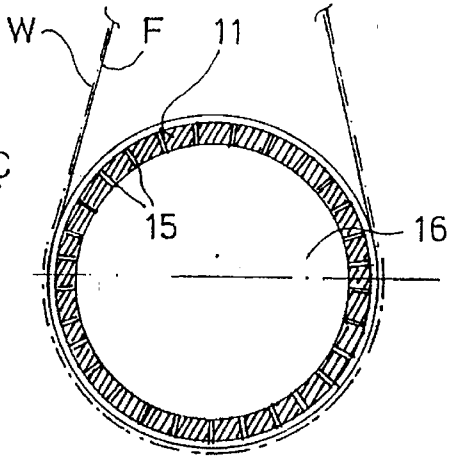
FIG. 1B PRIOR ART
FIGS. 1A and 1B are schematic sectional views of a prior art suction roll.
Figure 1A:
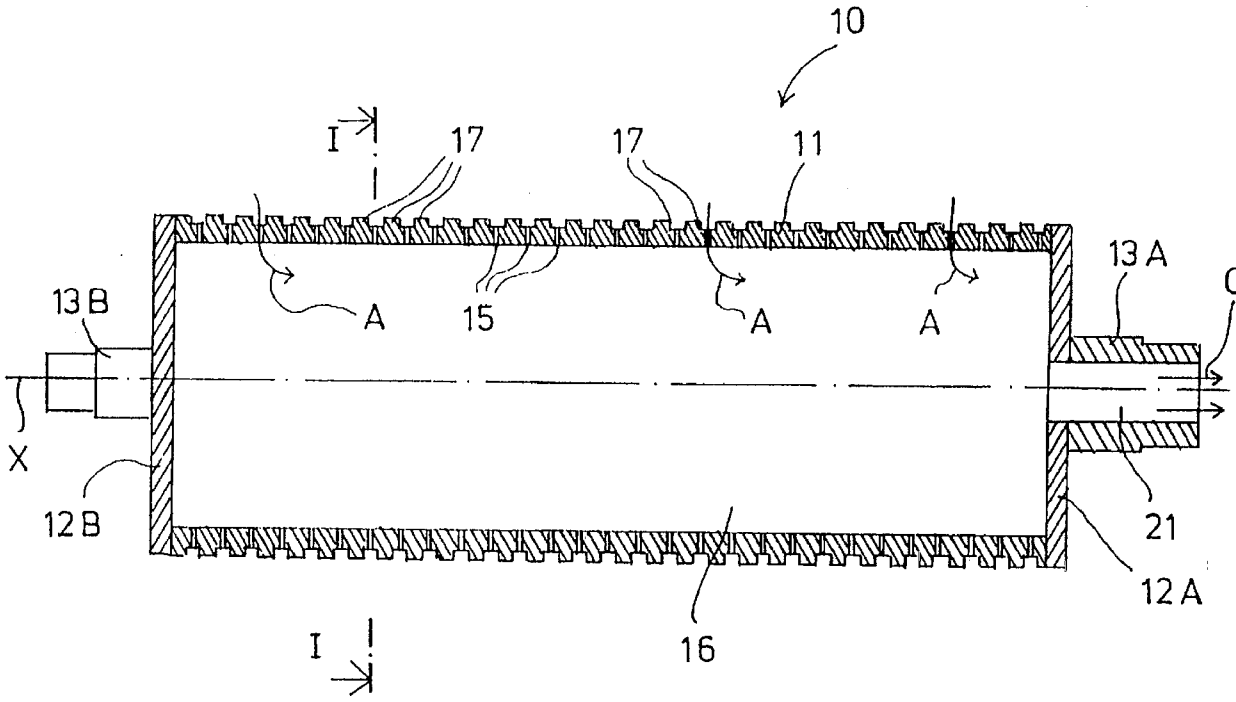
FIG. 1A PRIOR ART

FIGS. 1A and lB show a prior art suction roll 10. The suction roll 10 comprises a roll mantle 11 revolvingly mounted on axle journals 13A and 13B coupled to the roll mantle 11 by means of end flanges 12A and 12B, respectively. The roll mantle 11 includes perforations 15 which comprise a large number of holes 15 passing through the roll mantle 11 from its outer face to its inner face. In this manner, upon the application of a vacuum in an interior 16 of the suction roll 10, air is operatively drawn or sucked through the holes 15 in the roll mantle 11 into the interior 16 of the suction roll 10 (in the direction of arrows A), and a paper web W is thus drawn by means of the thus-generated vacuum into contact with the felt F or equivalent on which it is being carried over the suction roll 10 (FIG. 1B). A suction duct 21 is defined in, or connected to and extending through, the axle journal 13A, i.e., the axle journal 13A may be a hollow shaft alone acting as a duct or a separate duct member may be placed within the hollow shaft. The suction duct 21 can also be provided at both ends of the roll 10, i.e., one arranged in connection with each axle journal. The other end of the suction duct 21 is connected to a blower or to some other, equivalent source of vacuum/negative pressure (not shown). In this manner, the hold of the web against the felt F as they pass over the suction roll 10 is achieved by means of the suction roll 10, which has no stationary air sector. The perforations 15 are dimensioned so that the air flow rate through the perforations remains within controlled limits in all positions of the face of the roll mantle. In the assignee's suction roll of the VAC-ROLL™ type, there are additionally grooves 17 on the outer face of the roll mantle, which grooves equalize the vacuum. Such a roll is described in more detail in FI Pat. No. 83,680 mentioned above.

Figure 2B:
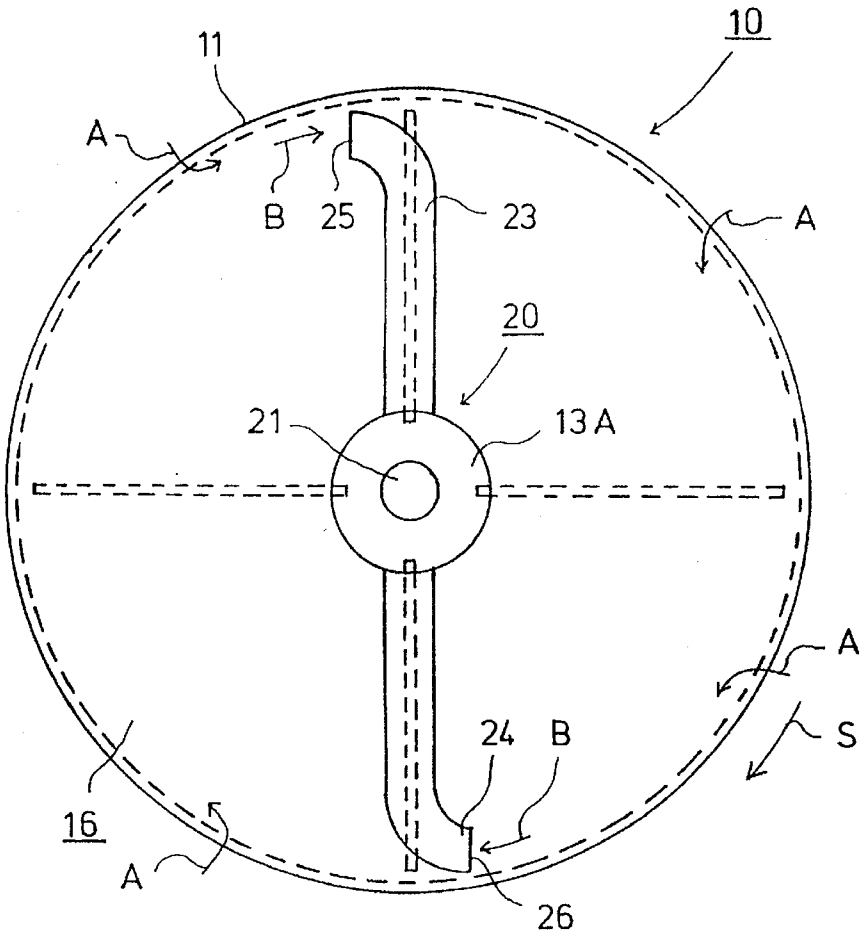
FIGS. 2A and 2B illustrate an arrangement in accordance with the invention for lowering the vacuum level in the suction duct of a suction roll, and which may be used in the method in accordance with the invention.
Figure 2A:
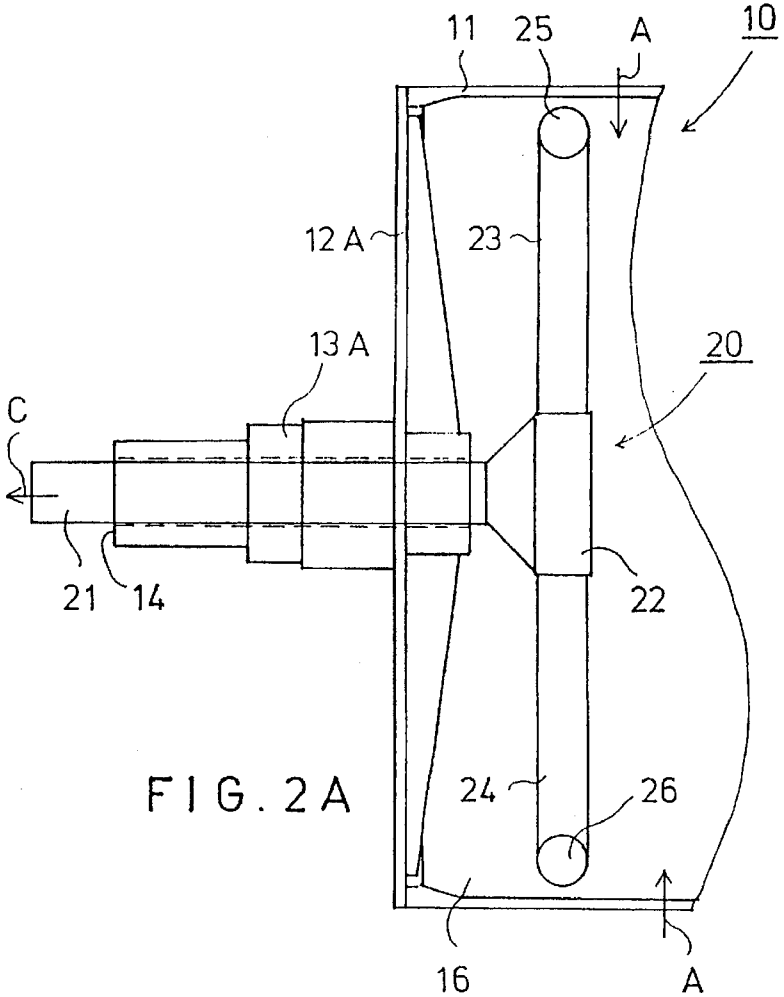

Referring now to FIGS. 2A and 2B wherein the same reference numerals refer to the same or similar elements, and the same nomenclature used above is also used in pertinent part, FIGS. 2A and 2B show an arrangement in accordance with the present invention in which a system of suction pipes 20 is placed inside a suction roll 10 at the side of an axle journal 13A of the suction roll 10. Air is drawn or sucked through the system 20 of pipes and through a suction duct 21 in flow communication therewith as an air flow C. Suction duct 21 is situated in a hollow central space of axle journal 13A. If a suction duct 21 is provided in connection with each of the axle journals 13A, 13B, a system of suction pipes 20 can then, of course, be fitted in connection with each of the axle journals. The suction duct 21 is placed in a hole 14 passing through the axle journal 13A. A connecting flange or flange part 22 is arranged at the end of the suction duct 21 inside the roll 10 and in the interior of the roll 10. The system of suction pipes 20 comprises at least one and preferably a pair of suction pipes 23,24, as shown in the illustrated embodiment, which are connected to the connecting flange 22 and extend from the connecting flange 22 outward, but within the roll interior, the connecting flange 22 being placed on or substantially close to a central axis X of the roll 10 (FIG. 1). The suction pipes 23,24 thus extend radially toward an inner face of a roll mantle 11 of the suction roll 10 and open at a location displaced from the central axis of the roll 10. The suction pipes 23,24 are preferably stationary while the suction roll 10 revolves, which is achieved by appropriate mounting components. The suction pipes 23,24 may also revolve at a speed substantially slower than the suction roll 10 or in the opposite direction of rotation than the direction of rotation of the suction roll 10.

The suction pipes 23 and 24 are placed so that their respective suction openings 25,26, at an end opposite to an end attached to the connecting flange 22, are placed in the vicinity of, i.e, proximate to, the inner face of the roll mantle 11 of the suction roll 10. More precisely, the suction openings 25,26 should be positioned so that when the roll 10 revolves, they are situated on the outer circumference of the inside revolving air flow (or in fact, anywhere within the revolving air flow). In this connection, when the suction roll 10 revolves in the direction of rotation S, air is sucked into the interior of the roll 10 through the holes 15 passing through the mantle 11 as the air flows A. Air flow A turns, by the effect of the rotation of the roll 10, in the way indicated by the arrow A, into the direction of rotation S of the roll 10. The ends of the suction pipes 23,24 are preferably bent or shaped so that the suction openings 25,26 are oriented in a direction substantially perpendicular to direction of the air flow B revolving along with the circumference, in which case the air is guided into the suction pipes 23,24 and drawn therethrough. From the suction pipes 23,24, the air is carried further through the connecting flange 22 into the suction duct 21 into the suction flow C.

When the suction pipes 23,24 are stationary or revolve at a speed substantially slower than the speed of the roll 10 mantle, by means of the described arrangement it is possible to eliminate the pressure loss, which is produced by centrifugal force, which depends on the speed, and which can be typically from about 300 Pa to about 500 Pa in a high-speed paper machine. At the same time, it is also possible to take advantage of the dynamic pressure of the air revolving along with the roll, which pressure is, in a high-speed paper machine, from about 200 Pa to about 300 Pa. In this manner, in the system of suction ducts, a lower vacuum of from about 500 Pa to about 800 Pa is produced with the same quantity of air, compared with the situation in a roll which is not provided with the arrangement in accordance with the invention, but the holding effect on the web remains the same.

It is an interesting aspect that with an increasing speed of rotation, the effect of the arrangement in accordance with the invention is increased, and so, along with the reduction of the pressure of the air quantity to be sucked, the consumption of energy can be reduced, because the level of vacuum in the system of suction ducts can be made lower. By means of the arrangement in accordance with the invention, it is also possible to subject the roll face to a reasonable suction effect without a source of vacuum, because in such an embodiment, when the roll revolves, air is discharged out of the open air duct by the effect of the rotation of the roll.

In FIGS. 2A and 2B, an embodiment is shown in which there are two suction pipes 23,24, but the scope of the invention, of course, also includes constructions in which there is just one suction pipe or in which there are more than two suction pipes.

Figure 3:
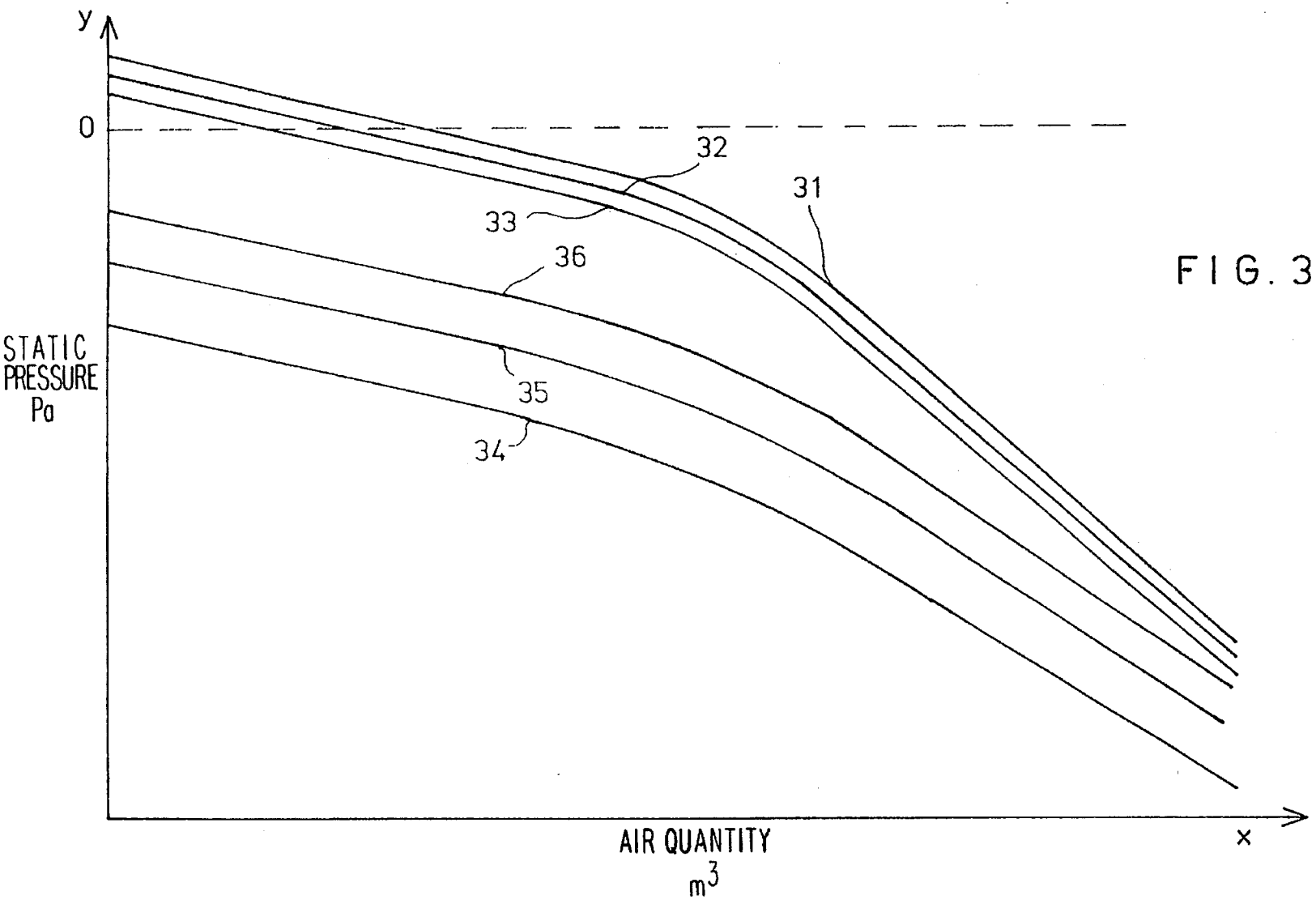
FIG. 3 is a schematic illustration of test results of the static pressure in the suction duct as a function of the air quantity in a prior art suction roll as compared with a suction roll provided with an arrangement in accordance with the invention.

FIG. 3 is a schematic illustration of test results concerning the static pressure in the suction duct of a suction roll (the y-axis coordinate) as a function of the air quantity (the x-axis coordinate)in a prior art suction roll as compared with a suction roll provided with an arrangement in accordance with the present invention. The curves 31,32,33 illustrate the test results of a suction roll provided with an arrangement in accordance with the invention, and the curves 34,35,36 illustrate the test results of the prior art arrangement. The vertical axis Y represents the pressure in the suction duct, and the horizontal axis X represents the air quantity that is sucked into the suction roll. The curves 31 and 34 illustrate the operative situation at a speed of rotation of about 1800 meters per minute (m/min), the curves 32 and 35 illustrate the operative situation at a speed of rotation of about at 1500 m/min, and the curves 33,36 illustrate the operative situation at a speed of rotation of about at 1200 m/min.

In FIG. 3, in the curves 31,32,33, which illustrate the arrangement in accordance with the invention, it is seen that the pressure level rises above the 0-pressure level at low air flow rates. In this portion, the flow is directed outward from the suction opening of the roll without an outside source of vacuum. From the curves 31,32,33; 34,35,36 it can also be seen that the relative sequence of the curves is changed, compare, for example, the curves 31;34. In other words, by means of the arrangement in accordance with the invention, a certain amount of air can be removed out of the roll more easily at higher speeds of rotation. In the prior art construction, the situation is the opposite, in which case the suction must be intensified to produce the same effect.

The examples provided above are not meant to be exclusive. Many other variations of the present invention would be obvious to those skilled in the art, and are contemplated to be within the scope of the appended claims.

We claim:

1. In a suction roll including a roll mantle, end flanges arranged at ends of said roll mantle and axle journals connected to said end flanges for rotatingly supporting said roll mantle, at least one of said axle journals defining a suction duct in flow communication with an interior of said roll, said roll mantle having an outer face, an inner face and plurality of apertures extending from said outer face to said inner face, the improvement comprising suction means for drawing air into said interior of said roll through said apertures and from said interior of said roll through said suction duct, said suction means comprising a suction pipe system arranged in flow communication with said suction duct, said suction pipe system including at least one suction pipe extending within said interior of said roll to a location proximate said inner face of said roll mantle such that air is drawn from the location proximate said inner face of said roll mantle through said suction pipe system into said suction duct.

2. The suction roll of claim 1, wherein said suction pipe system further comprises a flange part connected to said suction duct and said at least one suction pipe.

3. The suction roll of claim 1, wherein said at least one suction pipe comprises a pair of elongate suction pipes, each of said suction pipes having an end having a suction opening adjacent to said inner face of said roll mantle.

4. The suction roll of claim 3, wherein said end of said suction pipes adjacent to said inner face of said roll mantle is arranged such that said suction opening is oriented in a direction substantially perpendicular to a direction of air flow rotating in said interior of said roll during rotation of said roll.

5. The suction roll of claim 2, wherein said at least one suction pipe extends from said flange part in a radial direction of said roll toward said inner face of said roll mantle.

6. The suction roll of claim 1, wherein said suction duct is in flow communication with a source of vacuum.

7. The suction roll of claim 1, wherein said at least one suction pipe is mounted in a stationary position during operative rotation of said roll.

8. The suction roll of claim 1, wherein said suction pipe is arranged to rotate at a speed of rotation substantially slower than a speed of rotation of said roll.

9. The suction roll of claim 1, wherein said suction pipe is arranged to rotate in a direction opposite to a direction of rotation of said roll.

10. The suction roll of claim 1, wherein said at least one suction pipe comprises two suction pipes extending to different locations proximate to said inner face of said roll mantle and a flange part for connecting said two suction pipes.

11. The suction roll of claim 10, wherein said two suction pipes are placed substantially in a common plane in a direction transverse to an axial direction of said roll and extend from said flange part in opposite directions in relation to one another.

12. The suction roll of claim 1, wherein said suction duct is placed in a hole defined in one of said axle journals.

13. The suction roll of claim 10, wherein said flange part is placed substantially on a central axis of said roll.

14. The suction roll of claim 1, wherein said suction pipe system further comprises a flange part arranged on a central axis of said roll mantle, said at least one suction pipe being elongate and having a first end connected to said flange part and a second end opposed to said first end opening at the location proximate to said inner face of said roll mantle, said at least one suction pipe being sealed between said first and second ends.

15. A method for removing air from an interior of a suction roll including a roll mantle, end flanges arranged at ends of said roll mantle and axle journals connected to said end flanges for rotatingly supporting said roll mantle, at least one of said axle journals defining a suction duct, said roll mantle having an inner face, the method comprising the steps of:

directing air from a location proximate said inner face of said roll mantle into and through at least one suction pipe extending within said interior of said roll to the location proximate said inner face of said roll mantle, fluidly coupling said at least one suction pipe to said suction duct, and applying negative pressure through said suction duct.

16. The method of claim 15, wherein said at least one suction pipe comprises a pair of elongate suction pipes, each of said suction pipes having an end having a suction opening adjacent to said inner face of said roll mantle.

17. The method of claim 16, further comprising the step of:

orienting said suction openings of said suction pipes in a direction substantially perpendicular to a direction of air flow rotating in said interior of said roll during rotation of said roll.

18. The method of claim 15, further comprising the step of:

mounting said at least one suction pipe in a stationary position during operative rotation of said roll.

19. The method of claim 15, further comprising the steps of:

rotating said roll at a first speed, and rotating said at least one suction pipe at a second speed substantially slower than the first speed of rotation of said roll.

20. The method of claim 15, further comprising the steps of:

rotating said roll in a first direction of rotation, and rotating said at least one suction pipe in a second direction of rotation opposite to the first direction of rotation of said roll.

* * * * *